US006920642B2

(12) United States Patent
Dickens

(10) Patent No.: US 6,920,642 B2
(45) Date of Patent: Jul. 26, 2005

(54) NECKTIE KNOT SIMULATOR

(76) Inventor: Bart Dickens, P.O. Box 61406, Santa Barbara, CA (US) 93160

( * ) Notice: Subject to any disclaimer, the term of this patent is extended or adjusted under 35 U.S.C. 154(b) by 9 days.

(21) Appl. No.: 10/726,781

(22) Filed: Dec. 3, 2003

(65) Prior Publication Data

US 2005/0120461 A1 Jun. 9, 2005

(51) Int. Cl.[7] ..... A41D 25/08
(52) U.S. Cl. ..... 2/152.1
(58) Field of Search ..... 2/137, 138, 144–145, 2/147–149, 152.1, 150, 153

(56) References Cited

U.S. PATENT DOCUMENTS

| | | | | |
|---|---|---|---|---|
| 2,316,002 A | | 4/1943 | Koivisto | |
| 2,617,108 A | | 11/1952 | Anzell | |
| 2,654,095 A | | 10/1953 | Gougen | |
| 2,702,905 A | * | 3/1955 | Peake | 2/153 |
| 2,714,719 A | | 9/1955 | Peake | |
| 2,787,002 A | | 4/1957 | De La Piedra | |
| 3,745,614 A | | 7/1973 | Tsang | |
| 3,964,105 A | | 6/1976 | Gideon | |
| 3,999,222 A | | 12/1976 | Walborn | |
| 4,573,219 A | | 3/1986 | Hooten | |
| 4,748,692 A | | 6/1988 | Fukushima | |
| 5,010,593 A | * | 4/1991 | Stevens, Jr. | 2/153 |
| 5,035,002 A | | 7/1991 | Knight, Jr. | |
| 5,216,757 A | | 6/1993 | Dorkin | |
| 5,493,731 A | | 2/1996 | Amnott | |
| 5,920,907 A | | 7/1999 | Pierce | |
| 5,953,755 A | | 9/1999 | Barylski | |
| 6,094,746 A | | 8/2000 | Miller | |

* cited by examiner

*Primary Examiner*—Tejash Patel

(57) ABSTRACT

A necktie knot simulator closely resembling the shape of a necktie knot. Generally consisting of a one piece body with three properly dimensioned, fully enclosed circular apertures, one at the upper right, one at the upper left, and one at the base to provide both a means to thread a necktie through the necktie knot simulator and compressive resistance. The back side of the necktie knot simulator is predominantly open to allow wearer access to the necktie while threading it through the invention. The front surface of the necktie knot simulator can easily be modified to include inlays, logos, patterns or even precious and semi-precious gemstones.

1 Claim, 3 Drawing Sheets

NECKTIE KNOT SIMULATOR

CROSS-REFERENCE TO RELATED APPLICATIONS

N/A

FEDERALLY SPONSORED RESEARCH

N/A

SEQUENCE LISTING OR PROGRAM

N/A

BACKGROUND OF THE INVENTION

1. Field of the Invention

The present invention relates generally to a necktie knot simulator. More specifically, the invention concerns a knot simulator that allows the wearer the convenience of not having to tie a knot when wearing a necktie.

2. Discussion of Prior Art

There have, over the years, been many attempts to introduce a commercially accepted clasp or knot simulator for a necktie. Basically there have been two approaches. One approach has been a clasp that the wearer places over a pre-knotted necktie. With this approach the wearer is still required to tie a knot. The clasp in this approach basically amounts to a decorative cover. The second approach has been to configure the clasp to preclude the necessity of having to tie a knot.

U.S. Pat. No. 6,094,746 issued to Miller on Aug. 1, 2000 is an example of Prior Art that offers the user the option of either pre-tying a knot or threading the tie through designated openings.

U.S. Pat. No. 2,316,002 issued to Koivisto on Jul. 7, 1941 teaches an example of Prior Art that is placed over a pre-tied knot.

U.S. Pat. No. 2,714,719 issued to Peake on Sept. 9, 1955 is another Prior Art example of a knot protector that is placed over a pre-tied knot.

The Prior Art discussed above employs the first approach to a knot simulator. By design, these examples must be larger that the knot that they are intended to cover. With the necktie primarily being a fashion statement, the public has been reluctant to embrace any device that appears conspicuously larger than a standard knot.

The second design approach found in Prior Art attempts to construct a knot simulator or clasp in a manner that precludes the necessity of having to tie a knot.

U.S. Pat. No. 5,216,757 issued to Dorkin on Jun. 8, 1993 discloses a design with a single opening on the top. The clasp also pre-folds the tie in a somewhat unnatural manner. The use of a hinge and pin to secure the tie add to the manufacturing cost.

U.S. Pat. No. 5,953,755 issued to Baryiski on Sep. 21, 1999 discloses a design incorporating the single opening at the top approach.

U.S. Pat. No. 5,493,731 issued to Amnott on Feb. 27, 1996 teaches a solution with two opening at the top. While this might be an improvement over the single opening at the top approach, the two openings in an unnatural appearance direct the tie up the neck instead of around the collar.

U.S. Pat. No. 5,035,002 issued to Knight Jr. on Jun. 30, 1991 discloses another solution with a single opening at the top.

U.S. Pat. No. 4,748,692 issued to Fukushima on Jun. 7, 1988 teaches a solution complicated with an elaborate latching system and a single opening at the top.

U.S. Pat. No. 3,999,222 issued to Walborn on Dec. 22, 1976 teaches a solution similar to Amnott U.S. Pat. No. 5,493,731 where two top openings direct the tie straight up the neck rather than around the collar.

U.S. Pat. No. 3,964,105 issued to Gideon on Jun. 22, 1976 discloses a complicated design with three separate fastening devices fastened to a shield like knot simulator.

U.S. Pat. No. 3,745,614 issued to Tsang on Jul. 17, 1973 discloses a solution where the complexities of manufacture could render the object expensive to manufacture.

U.S. Pat. No. 2,787,002 issued to De La Piedra on Apr. 2, 1957 reveals the often-employed approach of having only one large opening at the top.

U.S. Pat. No. 2,654,095 issued to Gougen on Jan. 3, 1952 discloses another one opening at the top solution that is rather complicated consisting of multiple parts.

U.S. Pat. No. 2,617,108 issued to Anzell on Nov. 11, 1952 teaches still another single opening at the top approach.

In summary, this second design approach teaches one common solution. These Prior Art examples have a section of a tie that exits the top of the device. With this solution the section of the tie that exits the top of the device must be redirected from a north south orientation in order to wrap around the wearers collar. It is probable that a portion of the tie above the device will be visible before it turns behind the collar.

Additional design approaches can be discovered in Prior Art:

U.S. Pat. No. 4,573,219 issued to Hooten on Mar. 4, 1986 reveals a device that provides channels to thread a tie through. This solution includes a solid back and does not give the wearer the option of including a fold in the tie where it exits the lower aperture. The upper right and upper left apertures are described as sloped shoulders. These shoulders appear to be too narrow to conceal the tie as it exits the devise and make its way around the collar.

U.S. Pat. No. 5,920,907 issued to Pierce on Jul. 13, 1999 teaches a clasp that offers a system where interchangeable decorative surface attachments are employed.

OBJECTS AND ADVANTAGES

It is thus the object of the present invention to produce a necktie knot simulator. It is a further object of this invention to produce a necktie knot simulator that resembles the actual appearance of a conventionally tied knot. This appearance is achieved by casting or manufacturing the necktie knot simulator is such a manner that the upper right and upper left side wall apertures are positioned sufficiently far apart from each other to ensure that they will be covered by a shirt collar. With both apertures covered by said shirt collar, the user will be assured that no section of the necktie above the necktie knot simulator will be visible.

A further object of the invention is to provide three apertures of sufficient diameter and length to provide frictional resistance to ensure the invention remains in place on the necktie.

It is further an object of the invention to provide a necktie knot simulator that is economical to manufacture.

It is still further an object of the invention to provide a variety of designs or patterns on the front surface of the invention. In addition the invention may be produced in any number of materials including but not limited to silver, gold, plastic, and titanium.

It is still further an object of the invention to provide for the application of precious or semi-precious stones to the front surface.

SUMMARY

The present invention accomplishes the above stated objectives, as well as others, as may be determined by a fair reading and interpretation of the entire specifications.

DRAWINGS FIGURES

For a further understanding of the nature and objects of the present invention, reference should be had to the following detailed descriptions, taken in conjunction with the accompanying drawings, in which like elements are given the same or analogous reference numbers and wherein.

DETAILED DESCRIPTION-PREFERRED EMBODIMENTS

Figure 1:
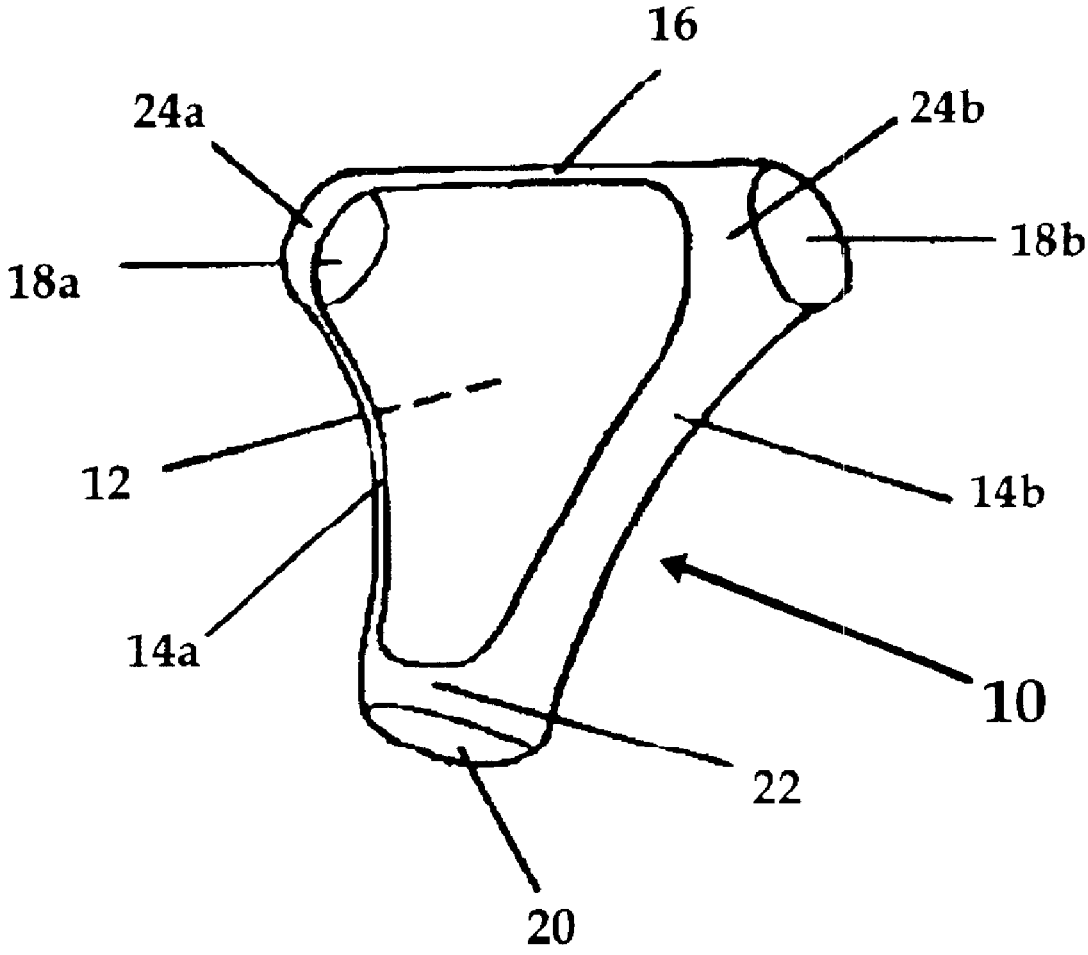
FIG. 1 is a perspective view of the backside of the necktie knot simulator.

As required, detailed embodiments of the present invention are disclosed herein. It is to be understood that the enclosed embodiments are merely exemplary of the invention that may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

FIG. 1 illustrates a knot simulator 10 as seen from the rear. Knot simulator 10 consists of a triangular-shaped body composed of a front surface 12, two side walls 14*a* and 14*b*, and a top wall 16 which extends between two side wall apertures 18*a* and 18*b*. Both side walls 14*a* and 14*b* as well as the top wall 16 are slightly rounded, presenting an accurate profile, enhancing the appearance. At the bottom of knot simulator 10, the two side walls 14*a* and 14*b* and the front surface 12 make up three fourths of the bottom aperture 20. With a small bridge 22, we provide the fourth side to complete the bottom aperture 20. The front surface 12, the two side walls 14*a* and 14*b*, and the small bridge 22 while listed as sides of the bottom aperture 20, in practice consist of four segments of a circle. The same practice will be observed at the two side wall apertures 18*a* and 18*b*. The side wall 14*a*, the front surface 12, and the top wall 16 make up three fourths of aperture 18*b*. With a small bridge 24*a*, we provide the fourth side to complete the aperture 18*a* The side wall 14*b*, the front surface 12, and the top wall 16 make up three fourths of aperture 18*b*. With a small bridge 24*b*, we provide we provide the fourth side to complete the aperture 18*b*. Similar to bottom aperture 20, both side wall aperture 18*a*and side wall aperture 18*b* are composed of four sides that combine to form a circle.

Figure 2:
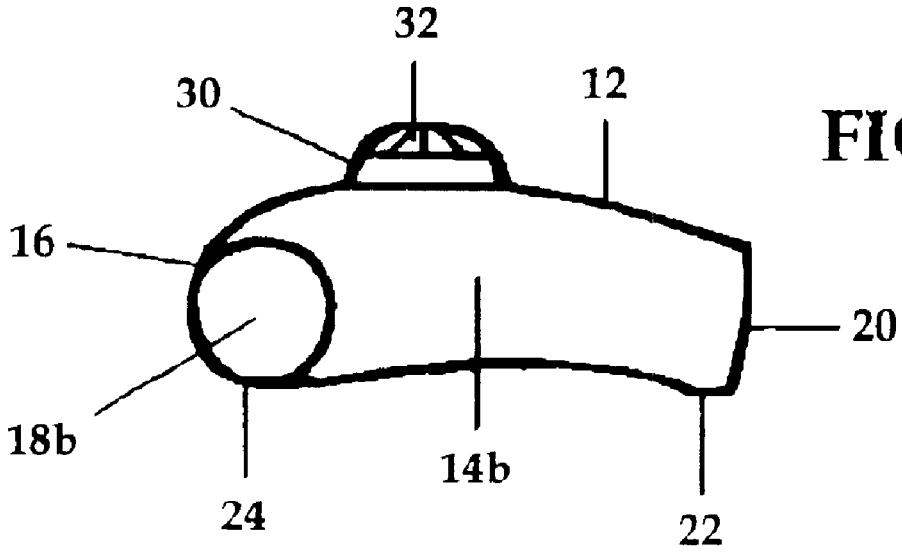
FIG. 2 is a side elevation view of the necktie knot simulator of FIG. 1 illustrating the addition of a precious or semi-precious stone mounted to the front surface.

FIG. 2 illustrates a second embodiment of the knot simulator 10 of FIG. 1. This second embodiment illustrates the addition of a precious of semi-precious gemstone 32. One technique for mounting a precious or semi-precious gemstone 32 would be the use of a bezel 30. FIG. 2 also illustrates a curvature of the front surface 12 further enhancing the natural appearance of the knot simulator 10.

Figure 3:
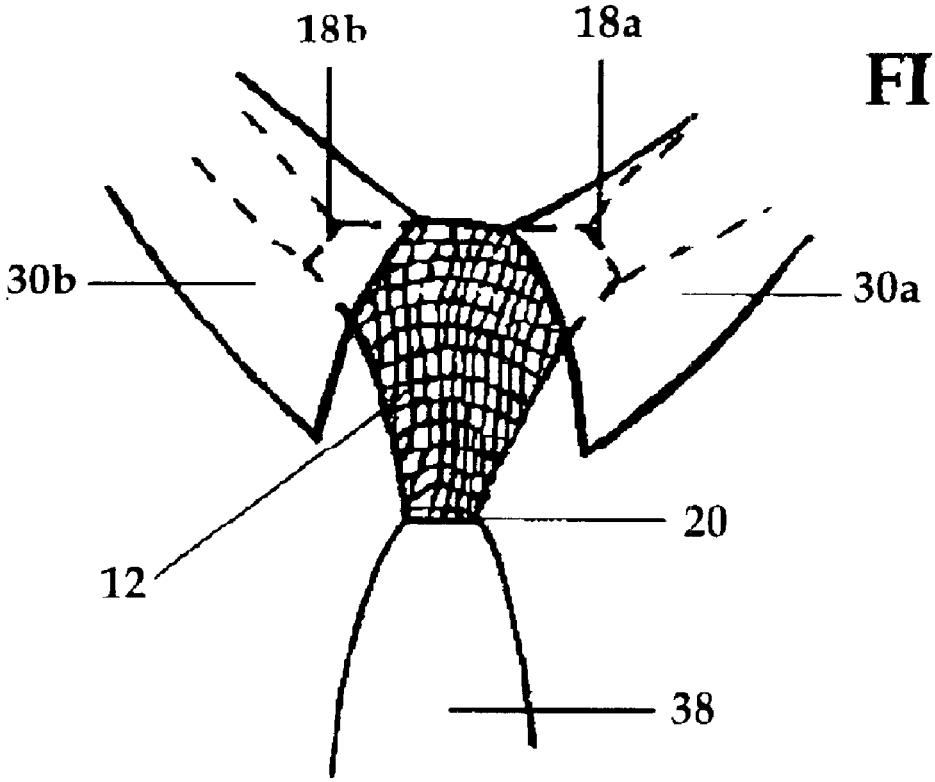
FIG. 3 is a front elevation view of the necktie knot simulator of FIG. 1 illustrating a preferred appearance of the invention when in use with a necktie.

FIG. 3 illustrates a third embodiment of the knot simulator 10 of FIG. 1. This third embodiment illustrates a design carved into the front surface 12. FIG. 3 also illustrates the left side wall aperture 18*a* covered by a shirt collar 30*a* and the right side wall aperture 18*b* also covered by a shirt collar 30*b*. One of the critical design features of knot simulator 10 is the fact that the left side wall aperture 18*a* and right side wall aperture 18*b* are sufficiently far apart to ensure the shirt collar 30*a* and 30*b* will cover said side wall apertures 18*a* and 18*b*. Side wall aperture 18*a* and side wall aperture 18*b* will be approximately 35 mm to 40 mm apart. The thickness of the knot simulator 10 will generally be uniform. With different materials this thickness will vary. In the first embodiment where the material used to manufacture the knot simulator 10 is sterling silver, the thickness is approximately 1 mm. It will also be a requirement that side wall aperture 18*a*, side wall aperture 18*b*, and the bottom aperture 20 be of accurate diameter and length to provide frictional resistance. A necktie 38 will dictate the actual required diameters. The current widths and material of choice, find that the right side wall aperture 18*a* and left side wall aperture 18*b* have a diameter range of 35 mm to 40 mm. The lower aperture 20 having both tails of the necktie 38 passing through will have a larger diameter of approximately 45 mm to 50 mm. The length of both side wall apertures 18*a* and 18*b* and the lower aperture 20 will be dependent on the necktie 38. Currently an optimal length will be in the range of 12 mm to 20 mm. Historically, necktie widths have changed over time. It will be necessary to resize the three apertures 18*a*, 18*b*, and 20 to accommodate the changing fashion dictates of the industry.

Figure 4:
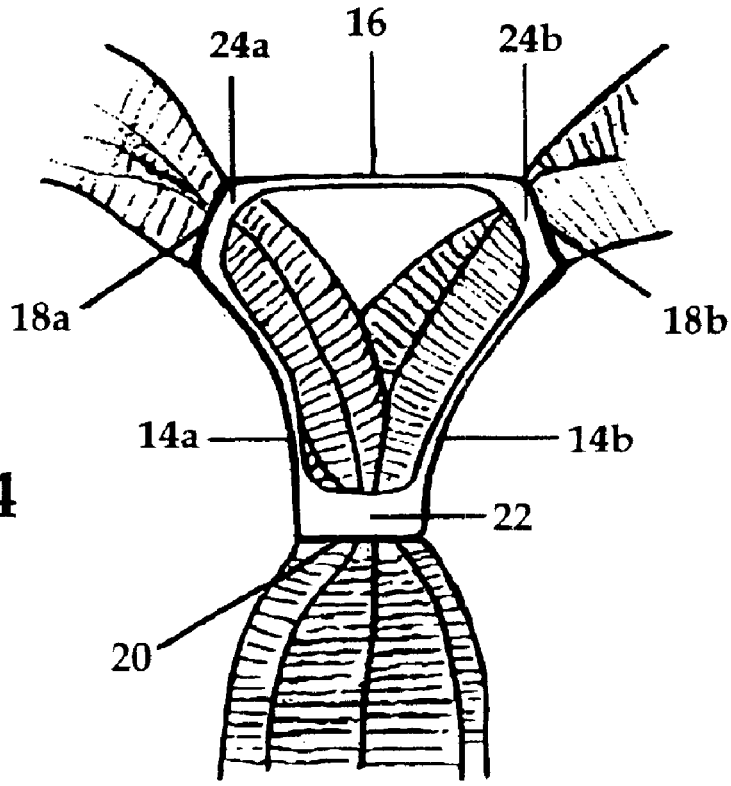
FIG. 4 is a rear elevation view of the necktie knot simulator of FIG. 1 illustrating a preferred use of the invention with a necktie passing through the three apertures.

FIG. 4 further illustrates the necktie 38 and how it is properly threaded through the knot simulator 10. The user begins by grasping the narrow end of the necktie 38 and passing it through the bottom of the lower aperture 20 into the knot simulator 10. The necktie 38 is then passed through side aperture 18*a* and out of the knot simulator 10. The user then creates a loop with the necktie 38 and passes the narrow end of the necktie 38 through side wall aperture 18*b* and back into the knot simulator 10. Next, the narrow end of the necktie 38 is passed through the lower aperture 20 and out of the knot simulator 10. Finally the knot simulator 10 and necktie 38 are placed under the collar 30, the ends are adjusted, and the knot simulator 10 is slid up snug so that the side apertures 18*a* and 18*b* are hidden by the shirt collars 30*a* and 30*b*.

Figure 5:
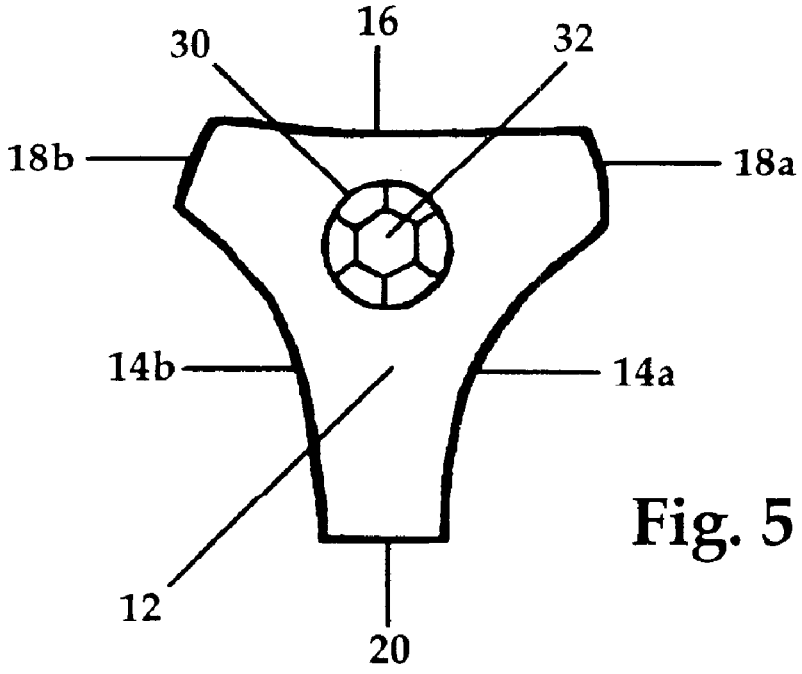
FIG. 5 is a front elevation view of the necktie knot simulator of FIG. 1 illustrating the addition of a precious or semi-precious stone to the front surface.

FIG. 5 further illustrates the second embodiment of FIG. 1 where the bezel 30 and precious or semi-precious stone 32 are illustrated in a front view. In all embodiments one or more designs, symbols, patterns, logos, lettering, or other indicia (collectively referred to as "indicia") as well as bezel 30 mounted precious or semi-precious stones 32 can be provided on at least the front surface 12 of the knot simulator 10.

While the present invention has been illustrated and described in detail in the drawings and foregoing description, the same is to be considered as illustrative and not restrictive in character, and that all changes and modifications that come within the spirit of the invention are desired to be protected. With respect to the above description then, it is to be realized that the optimum dimensional relationships for the knot simulator 10, will vary over time and accordingly one skilled in the art shall make dimensional adjustments accordingly. The instant invention has been shown and described herein in what is considered to be the most practical and preferred embodiment. It is recognized, however, that departures may be made therefrom within the scope of the invention and that all obvious modifications will occur to a person skilled in the art.

What is claimed is:

1. A Necktie Knot Simulator comprising (a) one piece shell member having an inverted triangular truncated front wall, a left side wall, a right side wall, a horizontal top wall, three small rear bridges, two fully enclosed circular side apertures located at the upper end of each said side wall and separated by said horizontal top wall, a fully enclosed circular bottom aperture located at the lower end of said side walls, and (b) said fully enclosed circular side apertures will be a specific diameter to provide compressive resistance to a necktie when said necktie is threaded thru, and (c) said fully enclosed circular bottom aperture will be a specific diameter to provide compressive resistance to said necktie when said necktie is threaded thru twice, and (d) the rear of said necktie knot simulator, comprised of three small bridges which serve to fully enclose said three circular apertures is substantially open to facilitate passing said necktie thru said fully enclosed circular apertures.

* * * * *